United States Patent [19]

Ebata

[11] 4,019,227

[45] Apr. 26, 1977

[54] SLIDE FASTENER STRINGERS

[75] Inventor: Hiroyuki Ebata, Uozu, Japan

[73] Assignee: Yoshida Kogyo Kabushiki Kaisha, Tokyo, Japan

[22] Filed: June 25, 1976

[21] Appl. No.: 699,691

[30] Foreign Application Priority Data

June 30, 1975 Japan ..... 50-81319

[52] U.S. Cl. ..... 24/205.16 R; 66/195; 24/205 R

[51] Int. Cl.[2] ..... A44G 19/34

[58] Field of Search ..... 24/205.16 R, 205.16 C, 24/205 R; 66/195; 139/384 B; 87/12, 13

[56] References Cited

UNITED STATES PATENTS 3,540,084 11/1970 Frohlich ..... 24/205.16 R 3,926,017 12/1975 Matsuda ..... 66/195

*Primary Examiner*—Bernard A. Gelak

*Attorney, Agent, or Firm*—Bucknam and Archer

[57] ABSTRACT

A slide fastener stringer tape comprising a major region made of a knitted fabric with an open, net-like texture, and a relatively narrow scoop-carrying region made of a warp-knitted fabric. The major tape region is longitudinally subdivided into several subregions of progressively finer mesh size from the one lying along one of its longitudinal edges to the one lying along the other longitudinal edge. The scoop-carrying region is arranged next to and along the finest mesh subregion of the major tape region, for supporting thereon a row of scoops of any desired type.

5 Claims, 4 Drawing Figures

SLIDE FASTENER STRINGERS

BACKGROUND OF THE INVENTION

This invention relates to slide fasteners, and more specifically to improvements in the stringers of slide fasteners for particular use with fishing nets, tents, covering sheets of fabric used at sites of construction, and similar articles.

The stringer tapes of slide fasteners as heretofore made have been fine textured and are therefore not quite suitable for use with the above listed articles having portions where permeability to fluids is required or at least desirable. When conventional slide fasteners are employed for interconnecting sections of fishing nets or protective fabric coverings used at construction sites, for example, their fine-textured stringer tapes hardly permit the passage therethrough of currents of ocean water or air. The stringer tapes thus augment the pulling forces applied to the fasteners by the currents of fluids. Moreover, the stringer tapes are incapable of absorbing such intense crosswise pulls, so that their connections to the article edges are particularly liable to be broken.

SUMMARY OF THE INVENTION

It is a principal object of this invention to provide improved stringers for slide fasteners which find special utility when used with fishing nets and other articles having portions required to be permeable to fluids.

Another object of the invention is to provide stringer tapes which are highly permeable to fluids and which are capable of effectively absorbing or distributing crosswise pulls to be exerted on the fasteners in their intended applications.

A further object of the invention is to provide fastener stringers which can be easily attached to desired articles.

Briefly, this invention is directed to the provision of a stringer tape for supporting thereof a row of scoops or fastener elements, the stringer tape including a major region made of a knitted fabric with a net-like texture and longitudinally divided into a plurality of subregions of increasingly finer mesh size from the one lying along one of the longitudinal edges of the major region toward the one lying along the other longitudinal edge thereof. The stringer tape further includes a relatively narrow scoop-carrying region on which the row of scoops is to be mounted. Extending along the said other longitudinal edge of the major region, the scoop-carrying region is made of a fabric, preferably a warp-knitted fabric.

For use a pair of such stringers are combined to provide a slide fastener which can be opened and closed by a usual slider movable in both directions along the interlocking rows of scoops. The slide fastener of this character is best suited for use in the aforementioned applications because the open, net-like texture of the major stringer tape regions offer minimum resistance to the passage of fluids therethrough and also because the warp-knitted fabric of the scoop-carrying regions is coarser than woven fabrics.

Furthermore, since the mesh of each stringer tape becomes progressively coarser from the scoop-carrying region toward the outermost subregion, a crosswise pull on the fastener can be effectively distributed over its length so that no intense, localized force is to be applied to the coupled rows of scoops. The connections between the stringer tapes and the article edges can also be protected from premature breakage under normal working conditions. The useful life of the slide fastener can therefore be materially extended.

The above and other objects, featured and advantages of this invention and the manner of attaining them will become more apparent, and the invention itself will best be understood, from a consideration of the following description taken in connection with the accompanying drawings showing certain preferred embodiments of the invention.

DESCRIPTION OF THE PREFERRED EMBODIMENTS

Figure 1:
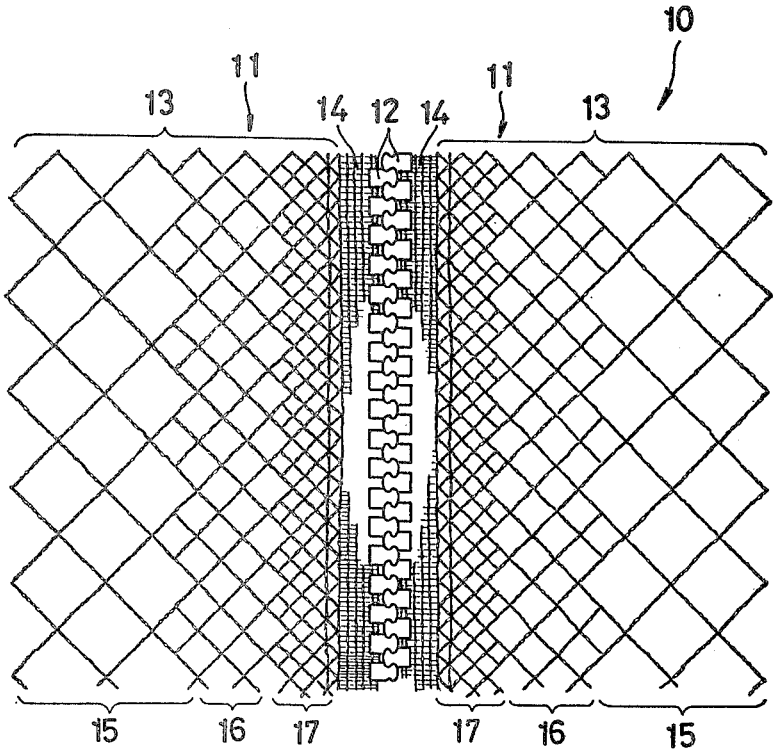
FIG. 1 is a partial plan view of a pair of slide fastener stringers embodying the principles of this invention.
Figure 2:
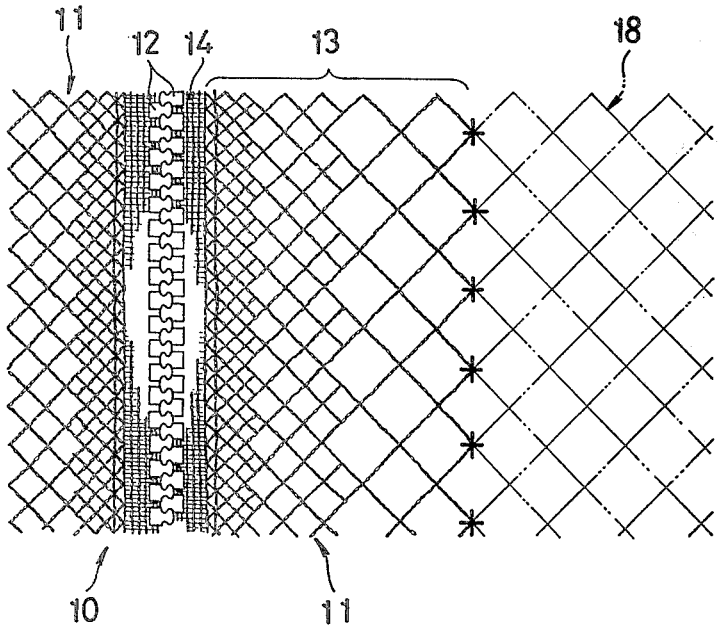
FIG. 2 is a view similar to FIG. 1 but showing the stringers with one of their tapes attached to a meshed article such as a fishing net.

A pair of slide fastener stringers shown in FIGS. 1 and 2 and generally designated 10 are representative of numerous possible embodiments of this invention. In FIG. 1, the fastener stringers 10 comprise tapes 11 carrying interlocking rows of scoops or fastener elements 12 of any known or suitable type which are shown coupled together. Each stringer tape 11 is broadly composed of a major region 13 made of a knitted fabric with an open, net-like texture, and a scoop-carrying region 14 of relatively small width made of a warp-knitted fabric.

The major region 13 of each stringer tape 11 is longitudinally subdivided into a plurality of, three in the illustrated embodiment, subregions 15, 16 and 17. The net-like texture of three subregions 15 to 17 becomes progressibely finer in mesh from the one lying along one of the longitudinal edges of the major region 13 toward the one lying along the other longitudinal edge.

The scoop-carrying region 14 of each stringer tape extends along the said other longitudinal edge of the major region 13, so as to lie next to its finest mesh subregion 17. The warp-knitted fabric of which the scoop-carrying region 14 is made is preferably finer in gauge or mesh than the subregion 17 of the major region 13 and can, for example, be a combination of tricot and crochet work. The scoops 12 are clamped or otherwise secured to this scoop-carrying region in the conventional manner.

With reference to FIG. 2, in the use of the slide fastener incorporating the pair of stringers 10 of the foregoing construction, the coarsest mesh subregions 15 of the major tape regions 13 may ordinarily be attached to the desired edges of an article 18 such as a fishing net by any suitable means. Preferably, the pitch of the meshes in the longitudinal direction of these coarsest mesh subregions should be made equal to the pitch of the meshes in the fishing net, or of eyelets in fabric coverings or the like, in order that the fastener stringers may be attached to such articles more easily and more neatly.

Figure 3:
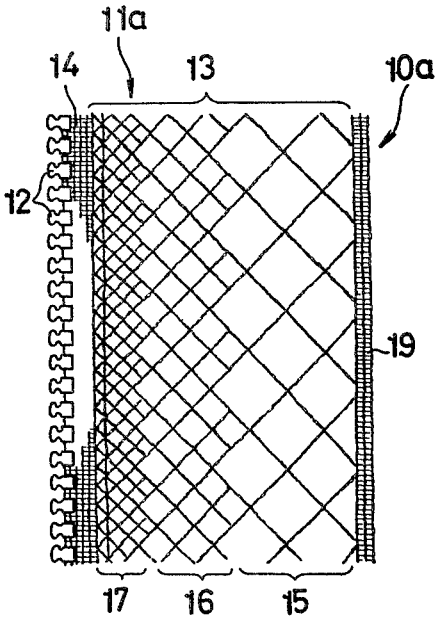
FIG. 3 is a partial plan view of a fastener stringer representing another preferred embodiment of this invention.

FIG. 3 illustrates another preferred embodiment of this invention, which differs from the preceding embodiment in that the tape 11*a* of each fastener stringer 10*a* has another warp-knitted fabric region 19 formed along the longitudinal edge of its major region 13 opposite to the scoop-carrying region 14. Due to the warp-knitted fabric regions 19, the pair of fastener stringers 10*a* can be attached to desired articles more easily by any such known method as stitching, bonding, or fusion welding. Furthermore, since the major region 13 of each stringer tape has its opposite longitudinal edges reinforced by the pair of warp-knitted fabric regions 14 and 19, the net-like texture of this major region can be stabilized.

Figure 4:
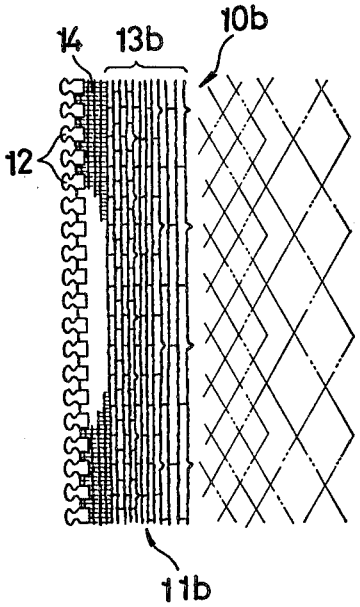
FIG. 4 is a view similar to FIG. 3 but showing still another preferred embodiment of the invention.

In still another preferred embodiment of the invention illustrated in FIG. 4, the tape 11*b* of each fastener stringer 10*b* has its major region 13*b* so knitted that its open, net-like texture has a tendency to be held in a transversely contacted state, as depicted by the solid lines in the drawing. In use the major tape region 13*b* can be expanded by crosswise pulling forces applied thereto by the article, as indicated by the twodot dash-lines in the same drawing.

Knitted in the above described manner, the major tape regions 13*b* of the fastener stringers 10*b* can have the same texture as that of, for example, fishing nets manufactured by known machines that are used exclusively for that purpose. The fastener stringers 10*b* are therefore extremely easy to attach to such fishing nets and are also easy to handle. It will now be clear that the objects as set forth above have been fully accomplished by the several practical forms of the fastener stringers disclosed. It is also understood, however, that the invention itself is not to be restricted by the exact showings of the accompanying drawings or the description thereof. For instance, the scoops mounted on the scoop-carrying regions of the various stringer tapes are shown to be of the discrete type, but this is purely be way of example. Any other type of scoops, which may be made of either plastics or metal, can be employed depending upon the intended applications or expected working conditions of the fastener stringers according to the invention.

The above and other modifications or variations of this invention within the usual knowledge of those skilled in the art are intended in the foregoing disclosure. It is therefore appropriate that the invention be construed broadly and in a manner consistent with the scope of the following claims.

What is claimed is:

1. A sliding clasp fastener stringer tape supporting a row of scoops thereon, comprising a major region made of a knitted fabric with a net-like texture, said major region being longitudinally divided into a plurality of subregions of progressively finer mesh size from the one lying along one of the longitudinal edges of said major region toward the one lying along the other longitudinal edge thereof, and a relatively narrow scoop-carrying region extending along said other longitudinal edge of said major region, said scoop-carrying region being made of a fabric with a finer texture than the finest mesh subregion of said major region, said row of scoops being mounted on said scoop-carrying region.

2. The stringer tape as recited in claim 1, the fabric of which said scoop-carrying region is made being warp-knitted.

3. The stringer tape as recited in claim 1, including another relatively narrow fabric region extending along said one longitudinal edge of said major region.

4. The stringer tape as recited in claim 3, said other fabric region being warp-knitted.

5. The stringer tape as recited in claim 1, said major region being so knitted as to have a tendency to be held in a transversely contracted state.

* * * * *